US010195758B2

(12) United States Patent
Abe

(10) Patent No.: US 10,195,758 B2
(45) Date of Patent: Feb. 5, 2019

(54) CUT DATA GENERATING APPARATUS AND NON-TRANSITORY RECORDING MEDIUM RECORDING CUT DATA GENERATING PROGRAM

(71) Applicant: BROTHER KOGYO KABUSHIKI KAISHA, Nagoya (JP)

(72) Inventor: Daisuke Abe, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/716,072

(22) Filed: Sep. 26, 2017

(65) Prior Publication Data

US 2018/0015629 A1 Jan. 18, 2018

Related U.S. Application Data

(63) Continuation of application No. PCT/JP2016/067646, filed on Jun. 14, 2016.

(30) Foreign Application Priority Data

Aug. 6, 2015 (JP) ..... 2015-155995

(51) Int. Cl.
*B26F 1/38* (2006.01)
*A41H 3/00* (2006.01)
*B26D 5/00* (2006.01)

(52) U.S. Cl.
CPC ..... *B26F 1/38* (2013.01); *A41H 3/007* (2013.01); *B26D 5/005* (2013.01); *B26F 1/3813* (2013.01)

(58) Field of Classification Search
CPC . B26F 1/38; B26F 1/813; B26D 5/005; A41H 3/007
See application file for complete search history.

(56) References Cited

U.S. PATENT DOCUMENTS 5,561,317 A * 10/1996 Momma ..... G03F 7/2002 257/431
5,859,690 A * 1/1999 Toguchi ..... G03F 7/70475 257/211

(Continued)

FOREIGN PATENT DOCUMENTS

EP 1342527 A1 9/2003
JP H06-348837 A 12/1994

(Continued)

OTHER PUBLICATIONS

International Preliminary Report on Patentability and Written Opinion issued in connection with International Patent Application No. PCT/JP2016/067646, dated Feb. 6, 2018. (6 pages).

*Primary Examiner* — Carol Wang
(74) *Attorney, Agent, or Firm* — K&L Gates LLP

(57) ABSTRACT

A cut data generating apparatus configured to generate cut data for a cutting apparatus including a cut mechanism to cut a pattern from a workpiece, the cut data generating apparatus comprising: a controller, the controller being configured to control the cut data generating apparatus to: identify a size of an original pattern to be cut; judge whether the size of the original pattern identified is larger than a size of the workpiece; divide the original pattern into plural divided patterns smaller than the size of the workpiece in case the size of the original pattern is larger than the size of the workpiece; and generate cut data for cutting each of the divided patterns, determine whether at least one of the plural divided patterns divided falls within one workpiece along with another divided pattern, and generate cut data for cutting the divided patterns from one workpiece in case at least one of the divided patterns falls within one workpiece along with another divided pattern.

14 Claims, 18 Drawing Sheets

(56) References Cited

U.S. PATENT DOCUMENTS

| | | | | |
|---|---|---|---|---|
| 2012/0253504 | A1 | 10/2012 | Kawaguchi et al. | |
| 2013/0180373 | A1* | 7/2013 | Abe | B26D 5/005 83/76.1 |
| 2013/0180374 | A1* | 7/2013 | Abe | B26D 5/00 83/76.8 |
| 2014/0260854 | A1* | 9/2014 | Tokura | B26F 1/3813 83/76.1 |

FOREIGN PATENT DOCUMENTS

| | | | |
|---|---|---|---|
| JP | 2000-024350 | A | 1/2000 |
| JP | 2003-251464 | A | 9/2003 |
| JP | 2010-184349 | | 8/2010 |
| JP | 2012-206237 | A | 10/2012 |

* cited by examiner

CUT DATA GENERATING APPARATUS AND NON-TRANSITORY RECORDING MEDIUM RECORDING CUT DATA GENERATING PROGRAM

CROSS-REFERENCE TO RELATED APPLICATION

This application is a continuation application of International Application No. PCT/JP2016/067646, filed on Jun. 14, 2016, which claims priority from Japanese Patent Application No. 2015-155995, filed on Aug. 6, 2015. The disclosure of the foregoing application is hereby incorporated by reference in its entirety.

FIELD

The present disclosure relates to a cut data generating apparatus and a non-transitory recording medium recording a cut data generating program for generating cut data for a cutting apparatus including a cut mechanism to cut a pattern in a predetermined shape from a workpiece.

BACKGROUND

Conventionally, a cutting apparatus is known in which a cut mechanism cuts a sheet-shaped workpiece, such as paper and cloth, into a predetermined shape based on cut data. The cutting apparatus is configured to hold the workpiece on a special-purpose rectangular mat to cut the workpiece. In this case, an adhesive layer is provided on an upper surface of the mat except for left and right edge portions, and the workpiece is attached to the adhesive layer and held.

SUMMARY

In the cutting apparatus, the size of the pattern that can be cut based on the cut data cannot exceed the size of the workpiece that can be held by the special-purpose mat. Therefore, the cut data cannot be conventionally generated for a large pattern exceeding the size of the workpiece that can be held by the mat. Accordingly, it is desired to allow cutting a large pattern.

An object of the present disclosure is to provide a cut data generating apparatus and a non-transitory recording medium recording a cut data generating program capable of generating cut data for cutting a pattern in a predetermined shape from a workpiece, the cut data allowing to cut a large pattern exceeding the size of one workpiece.

In order to attain the above-mentioned object, one aspect of the present disclosure provides a cut data generating apparatus configured to generate cut data for a cutting apparatus including a cut mechanism to cut a pattern from a workpiece, the cut data generating apparatus comprising: a controller, the controller being configured to control the cut data generating apparatus to: identify a size of an original pattern to be cut; judge whether the size of the original pattern identified is larger than a size of the workpiece; divide the original pattern into plural divided patterns smaller than the size of the workpiece in case the size of the original pattern is larger than the size of the workpiece; determine whether at least one of the plural divided patterns falls within one workpiece along with another divided pattern; and generate cut data for cutting the divided patterns from one workpiece in case at least one of the divided patterns falls within one workpiece along with another divided pattern.

This summary is not intended to identify critical or essential features of the disclosure, but instead merely summarizes certain features and variations thereof. Other details and features will be described in the sections that follow.

BRIEF DESCRIPTION OF THE DRAWINGS

Aspects of the disclosure are illustrated by way of example, and not by limitation, in the accompanying figures in which like reference characters may indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments will be described with reference to the accompanying drawings.

(1) First Embodiment

Figure 1:
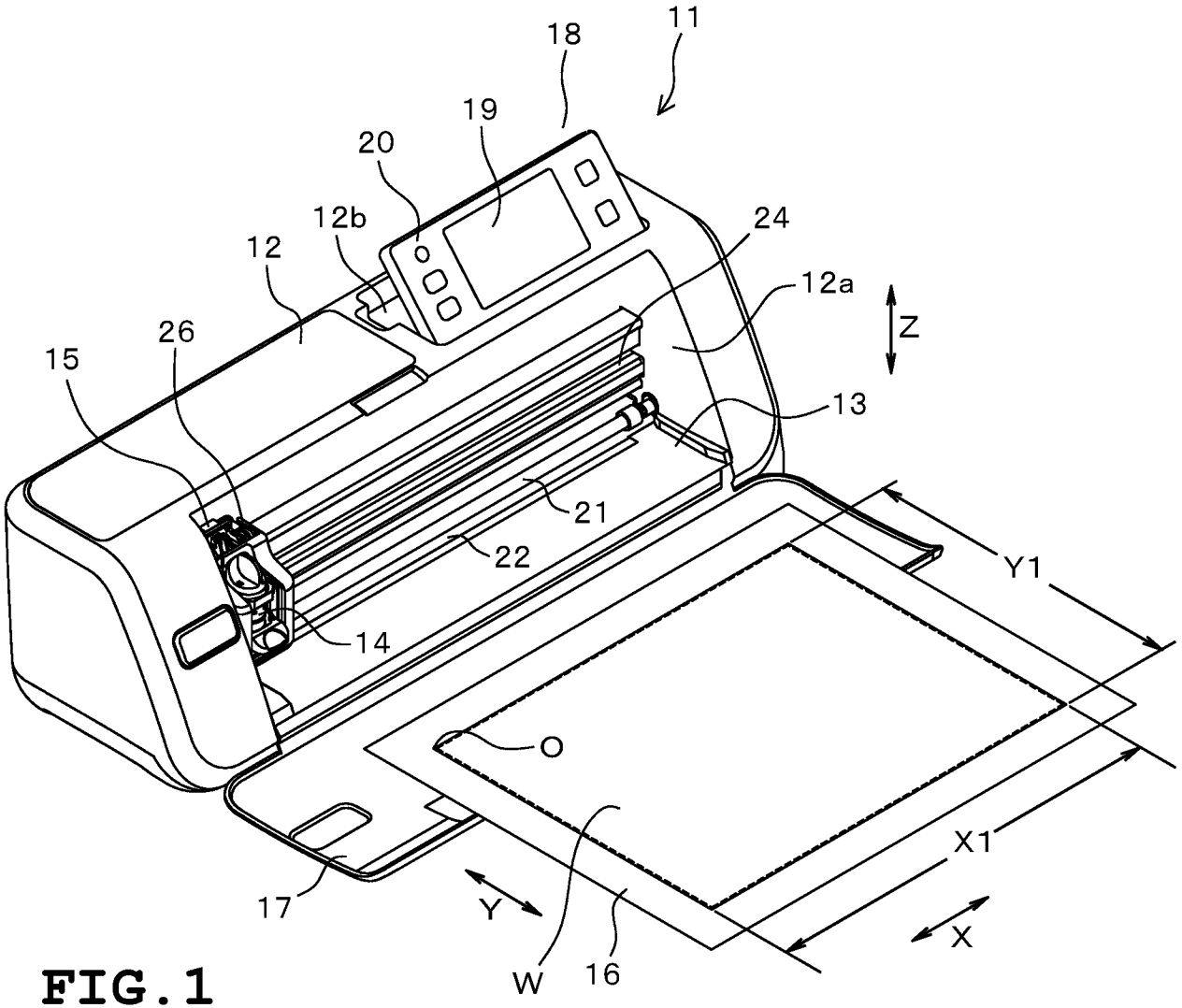
FIG. 1 is a perspective view illustrating a first embodiment of the present disclosure and schematically illustrating an appearance of a cutting apparatus as a cut data generating apparatus.
Figure 2:
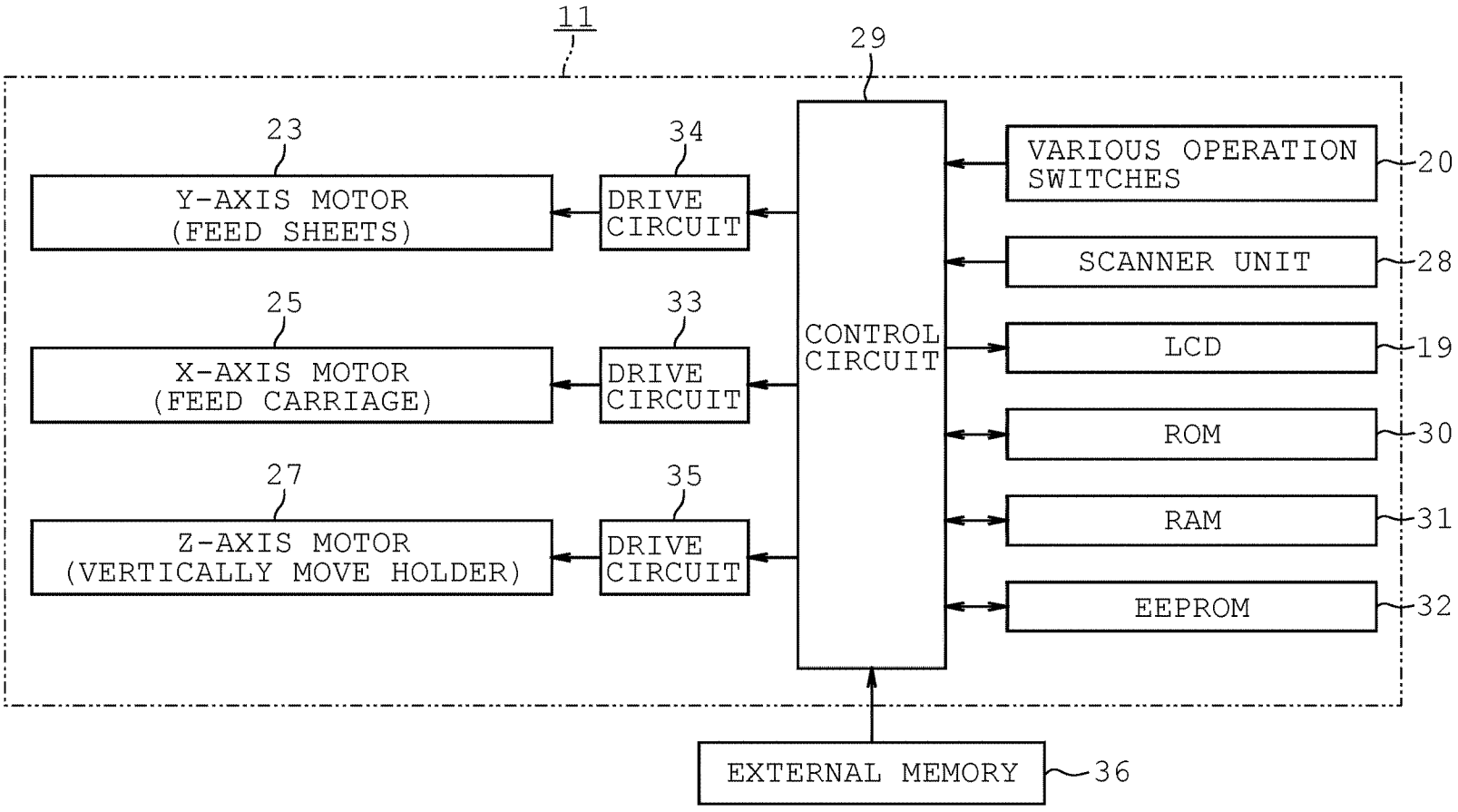
FIG. 2 is a block diagram schematically illustrating an electrical configuration of the cutting apparatus.

A first embodiment of the present disclosure will now be explained with reference to FIGS. 1 to 13. In the first embodiment, a cutting apparatus also serves as a cut data generating apparatus. FIG. 1 illustrates an external configuration of a cutting apparatus 11 as a cut data generating apparatus according to the present embodiment. FIG. 2 schematically illustrates an electrical configuration of the cutting apparatus 11. The cutting apparatus 11 is an apparatus configured to cut a workpiece W, such as paper and a sheet, according to cut data.

As illustrated in FIG. 1, the cutting apparatus 11 includes: a body cover 12; a platen 13 disposed in the body cover 12; and a cut head 15 including a cutter cartridge 14. The cutting apparatus 11 includes a holding member 16 for holding the workpiece W that is an object to be cut. The holding member 16 includes: a base portion in a shape rectangular and thin as a whole; and an adhesive layer provided on an upper surface of the base portion. The adhesive layer is provided in a rectangular shape except for edge portions of four sides of the base portion, and the adhesive layer holds the workpiece W in a manner that the workpiece W can be peeled off.

Directions in the present embodiment will be defined here. A direction in which the holding member 16 is fed by a feed mechanism described later is defined as a forward and rearward direction (Y direction). A direction in which the cut head 15 is transferred by a cutter transfer mechanism described later is defined as a left and right direction (X direction). A direction orthogonal to the forward and rearward direction and the left and right direction is defined as an up and down direction (Z direction). As illustrated in FIG. 1, an X-Y coordinate system with an origin O at the corner on the rear left side of the adhesive portion of the holding member 16 is set in the cutting apparatus 11, and cutting operation is controlled based on cut data indicated by the X-Y coordinate system. The adhesive layer of the holding member 16 has sides extending in the X direction and the Y direction, and the size of the workpiece W that can be held is X1 for the dimension in the left and right direction and Y1 for the dimension in the forward and rearward direction.

The body cover 12 is shaped like a laterally elongated rectangular box, and a front opening 12*a* that laterally opens is formed on a front portion. The holding member 16 is inserted into the cutting apparatus 11 from the front opening 12*a* and is set on an upper surface of the platen 13. The holding member 16 set on the platen 13 is fed in the forward and rearward direction (Y direction).

An operation panel 18 is provided on a right side part of an upper surface of the body cover 12. The operation panel 18 is provided with: a liquid crystal display 19; and various operation switches 20 for the user to perform various instruction, selection, or input operations. The various operation switches 20 also include a touch panel provided on a surface of the display 19. The feed mechanism configured to feed the holding member 16 in the forward and rearward direction (Y direction) on the upper surface of the platen 13 is provided in the body cover 12. The cutter transfer mechanism configured to transfer the cut head 15 in the left and right direction (X direction) is further provided.

The feed mechanism will be explained. A pinch roller 21 and a drive roller 22 extending in the left and right direction are provided one over the other in the body cover 12. Left and right edge portions of the holding member 16 are held between the pinch roller 21 and the drive roller 22, and the holding member 16 is fed in the forward and rearward direction. Although not illustrated in detail, a Y-axis motor 23 (illustrated only in FIG. 2) and a gear mechanism configured to transmit rotation of the Y-axis motor 23 to the drive roller 22 are provided on a right side portion in the body cover 12. In this way, the Y-axis motor 23 rotates the drive roller 22, and the feed mechanism feeds the holding member 16 in the forward and rearward direction.

Next, the cutter transfer mechanism will be explained. A guide rail 24 located behind and above the pinch roller 21 and extending in the left and right direction is disposed in the body cover 12. The cut head 15 is supported by the guide rail 24 in a manner that the cut head 15 can move in the left and right direction. Although not illustrated in detail, an X-axis motor 25 (illustrated only in FIG. 2) and a drive pulley rotated by the X-axis motor 25 are provided on a left side part in the body cover 12.

On the other hand, a follower pulley is provided on the right side portion in the body cover 12 although not illustrated. An endless timing belt extending in the left and right direction horizontally stretches over the drive pulley and the follower pulley. An intermediate portion of the timing belt is connected to the cut head 15. In this way, the cutter transfer mechanism rotates the X-axis motor 25 to move the cut head 15 in the left and right direction through the timing belt.

The cut head 15 includes a cartridge holder 26 and an up-down drive mechanism configured to drive the cartridge holder 26 in the up and down direction. The cartridge holder 26 holds the cutter cartridge 14 in a manner that the cutter cartridge 14 can be attached and detached. Although not illustrated, the cutter cartridge 14 includes a cutter. A blade portion is formed on a lower end of the cutter. The cutter cartridge 14 holds the cutter at a position where the blade portion slightly protrudes from a lower end portion of a case.

The up-down drive mechanism includes a Z-axis motor 27 (illustrated only in FIG. 2) and the like and is configured to move the cutter cartridge 14 between a lowered position where the blade portion of the cutter cuts the workpiece and a lifted position where the blade portion of the cutter is spaced apart upward from the workpiece by a predetermined distance. The cutter cartridge 14 is located at the lifted position at a normal time, that is, when the cutting operation is not performed, and is moved to the lowered position by the up-down drive mechanism during the cutting operation.

The cut mechanism is configured in this way, and the blade portion of the cutter penetrates through, in a thickness direction, the workpiece W that is an object to be cut held by the holding member 16 during the cutting operation. In this state, the feed mechanism moves the workpiece W held by the holding member 16 in the forward and rearward direction, and the cutter transfer mechanism moves the cut head 15, that is, the cutter, in the left and right direction to perform the cutting operation of the workpiece W. Note that the cutting apparatus 11 of the present embodiment is provided with a scanner unit 28 configured to read a pattern on a surface of an original image or the like held by the holding member 16 as illustrated only in FIG. 2.

As illustrated in FIG. 2, the cutting apparatus 11 includes a control circuit 29 as a control section. The control circuit 29 mainly includes a computer (CPU) and is responsible for the control of the entire cutting apparatus 11. The LCD 19 and the various operation switches 20 are connected to the control circuit 29, and a ROM 30, a RAM 31, and an EEPROM 32 are also connected to the control circuit 29. Drive circuits 33, 34, and 35 configured to drive the X-axis motor 25, the Y-axis motor 23, and the Z-axis motor 27, respectively, are also connected to the control circuit 29. An external memory 36, such as a USB memory, can also be connected to the control circuit 29.

The ROM 30 stores various control programs, such as a cutting control program for controlling the cutting operation, a cut data generating program for generating and editing the cut data, and a display control program for controlling the display of the LCD 19. The RAM 31 temporarily stores data and programs necessary for various processes. The EEPROM 32 or the external memory 36 stores pattern data indicating shapes regarding a large number of patterns or cut data generated for cutting a pattern in a predetermined shape.

The EEPROM 32 also stores data of the size of the workpiece W that can be held by the holding member 16, that is, the size of the workpiece W that can be cut in one cutting operation, or in this case, the data indicating the left and right dimension X1 and the forward and rearward dimension Y1. Although the size of the workpiece W may be stored in advance, the actual size of the workpiece W held by the holding member 16 may be identified, and a size judging process described later may be executed based on the size of the workpiece W. In this case, examples of the method of identifying the actual size of the workpiece W include manual input by the user and measurement of the size of the workpiece W on the holding member 16 by the scanner unit 28.

The cut data is data indicating the cut position for cutting the workpiece W, and the cut data includes a set of data of coordinate values indicating the X-Y coordinate system of the cut position. The control circuit 29 executes the cutting control program to control the X-axis motor 25, the Y-axis motor 23, and the Z-axis motor 27 through the drive circuits 33, 34, and 35, respectively, according to the cut data to automatically execute the cutting operation of the workpiece W held by the holding member 16.

In the present embodiment, the control circuit 29 executes the cut data generating program to execute each process of the cut data generating apparatus configured to generate the cut data. Other than being stored in advance in the ROM 30, the cut data generating program may be recorded in an external recording medium, such as an optical disk, and read from the recording medium. The cut data generating program may also be downloaded from the outside through a network.

The cut data is usually generated by, for example, obtaining an outline expressing a pattern in a closed shape based on pattern data of the pattern to be cut selected by the user from plural patterns stored in the EEPROM 32 or read by the scanner unit 28 and generating cut data for cutting the pattern along the outline based on the data of the outline.

In this case, in generating the cut data in the present embodiment, the control circuit 29 executes a size identifying process of identifying a size of a target pattern (referred to as an original pattern F) from the pattern data of the original pattern F, that is, horizontal and vertical sizes X2 and Y2. The data of the size of the original pattern F may be calculated based on the pattern data at the generation of the cut data or may be stored in advance in the EEPROM 32 or the like along with the pattern data. Next, the control circuit 29 executes a size judging process of judging whether the identified size of the original pattern F is larger than the size of the workpiece W (horizontal and vertical sizes X1 and Y1). If the size of the original pattern F is smaller than the size of the workpiece W, the control circuit 29 executes a normal cut data generating process. The normal cut data generating process here is a process of generating the cut data for cutting the original pattern F from one workpiece W based on the pattern data of the original pattern F without executing a dividing process described later.

If the control circuit 29 judges that the size of the original pattern F is larger than the size of the workpiece W, the control circuit 29 executes a dividing process of using dividing lines P to divide the original pattern F into plural divided patterns D smaller than the size of the workpiece W. Subsequently, the control circuit 29 executes a cut data generating process of creating cut data for cutting each of the divided patterns D. Therefore, the control circuit 29 functions as a size identifying section, a size judging section, a dividing section, and a cut data creating section.

Figure 3A:
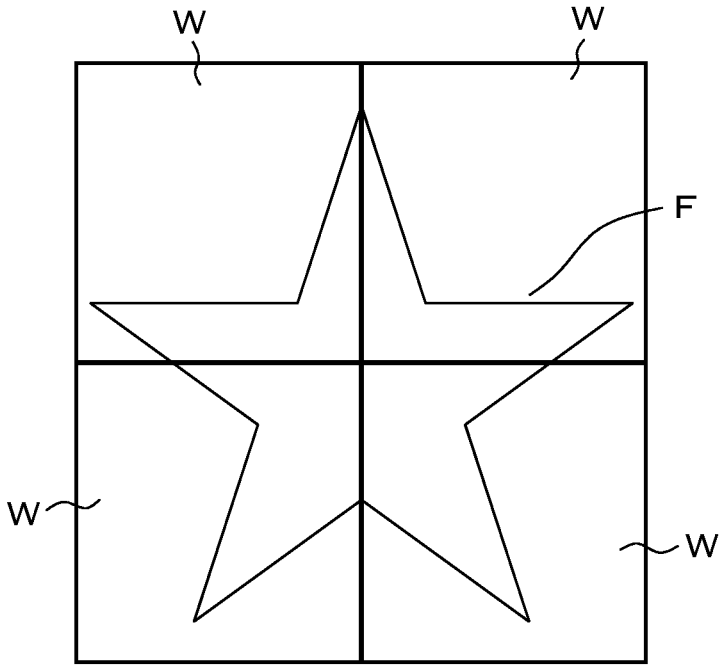
FIG. 3A illustrates an original pattern.
Figure 3B:
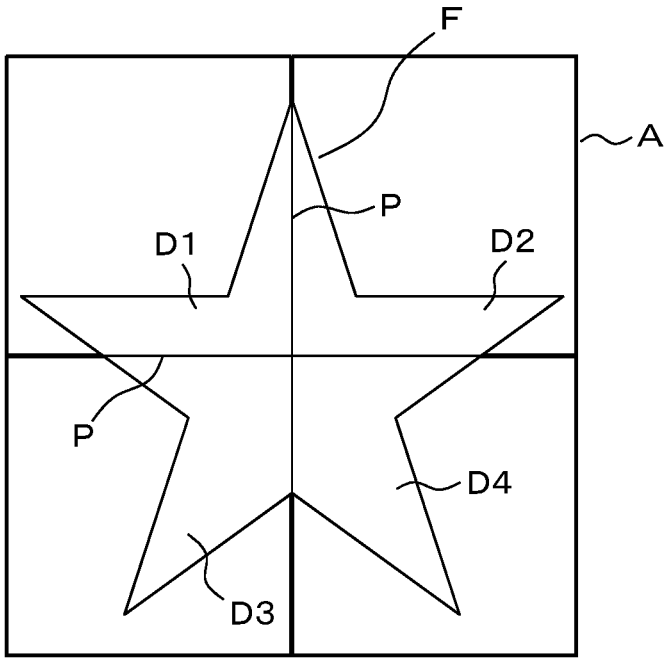
FIG. 3B illustrates a divided original pattern.

FIGS. 3A and 3B illustrate the original pattern F of a "star" as a specific example of the pattern. As illustrated in FIG. 3A, the vertical and horizontal sizes of the original pattern F fall within sizes twice the vertical and horizontal sizes of the workpiece W, that is, within four workpieces W. In this case, as illustrated in FIG. 3B, an entire area A is set in which two workpieces W are arranged vertically, and two workpieces W are arranged horizontally. In dividing the original pattern F, for example, the original pattern F is arranged in the entire area A such that center points of the original pattern F in the vertical and horizontal directions coincide with a center point of the entire area A as illustrated in FIG. 3B. In this way, the original pattern F is divided into four divided patterns D1 to D4 based on the dividing line P extending in the horizontal direction at the center in the up and down direction and the dividing line P extending in the vertical direction at the center in the left and right direction.

In the present embodiment, the control circuit 29 functions as a margin adding section configured to execute a margin adding process of adding, to some of divided pattern D, a margin M as a joining margin partially overlapping with another adjacent divided pattern D. In the cut data creating process of each divided pattern D, the control circuit 29 generates cut data including the margin M added in the margin adding process.

More specifically, in executing the margin adding process for the divided pattern D, the control circuit 29 functions as a shape acquiring section configured to execute a shape acquiring process of acquiring the shape of an adjacent part overlapping with the margin M in another adjacent divided pattern D. The control circuit 29 then adds the margin M shaped to fall within or coincide with the shape of the adjacent part acquired in the shape acquiring process. In this case, the control circuit 29 also serves as a margin size determining section configured to execute a process of determining a width dimension L of the margin M in the direction of protrusion from the dividing side of the divided pattern D based on the size of the original pattern F. The dividing side is a side which is in contact with the dividing line in each of the adjacent partial patterns.

When adding the margin M to the divided pattern D, the control circuit 29 also initially generates the margin M in a predetermined shape and judges whether the margin M falls within the shape of the adjacent part. In the present embodiment, "falling within the shape of the adjacent part" also includes coinciding with the shape of the adjacent part. If the control circuit 29 judges that the margin M does not fall within the shape of the adjacent part, the control circuit 29 corrects the margin M into a shape falling within the shape of the adjacent part. Specifically, the control circuit 29 executes a process of deleting the part of the margin M sticking out from the shape of the adjacent part.

In the present embodiment, the control circuit 29 further generates boundary data for providing, with respect the divided pattern D provided with the margin M, to the workpiece W, a mark indicating a boundary B between the divided pattern D and the margin M in the cut data creating process. For the mark, a dotted line for cutting at the boundary B can be provided, that is, intermittent incisions can be provided, or the boundary B can be drawn by a pen. Such a mark can be provided to the workpiece W based on the boundary data.

Figure 4:
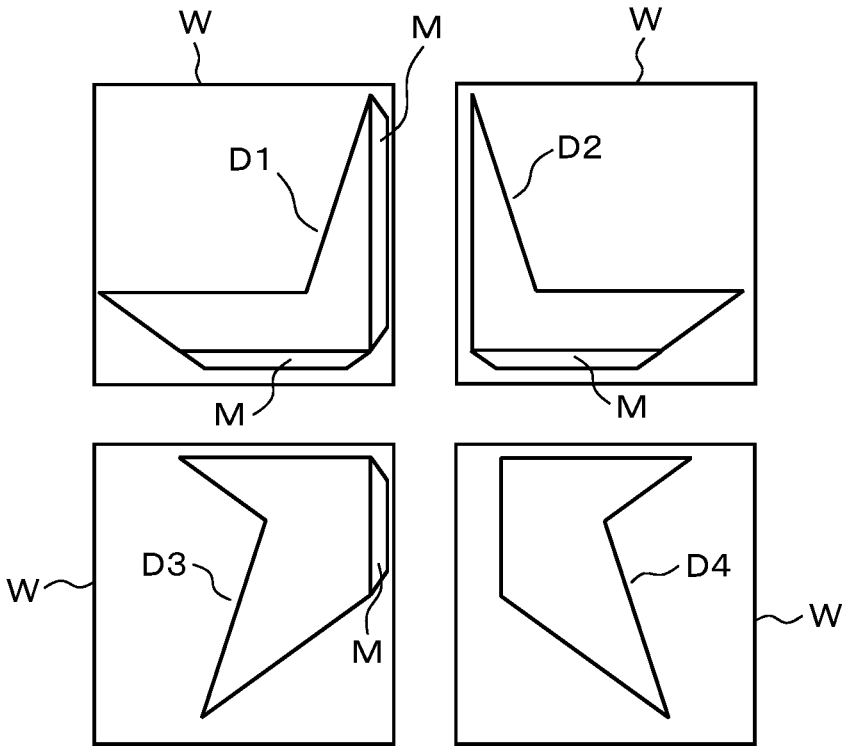
FIG. 4 illustrates divided patterns provided with margins.

FIG. 4 illustrates division of the original pattern F in the "star" into four divided patterns D1 to D4 and adding the margins M to the divided patterns D1 to D3, that is, cutting the divided patterns D1 to D4 with margins M from four workpieces W. As described later, for the divided pattern D1, the margins M are added to a right side portion, that is, a part adjacent to the divided pattern D2, and to a lower side portion, that is, a part adjacent to the divided pattern D3. For the divided pattern D2, the margin M is added to a lower side portion, that is, a part adjacent to the divided pattern D4. For the divided pattern D3, the margin M is added to a right side portion, that is, a part adjacent to the divided pattern D4. For the divided pattern D4, the margin M is not added.

In the process of dividing the original pattern F into the plural divided patterns D, the control circuit 29 executes a determining process of determining whether at least one of the plural divided patterns D divided by the dividing section falls within one workpiece W along with another divided pattern D in the present embodiment. Therefore, the control circuit 29 also functions as a determination section. When the control circuit 29 determines that at least one of the divided patterns falls within one workpiece along with another divided pattern, the control circuit 29 rearranges the plural divided patterns D with respect to the workpiece W and generates cut data for cutting the divided patterns D from one workpiece W in the cut data creating process.

When the margins M are added to the divided patterns D as described above, the control circuit 29 judges whether at least one of the divided patterns D after the adding process of the margins M falls within one workpiece W along with another divided pattern D in the determining process, and the control circuit 29 rearranges, with respect to the workpiece W, the divided patterns D provided with the margins M.

Figure 5:
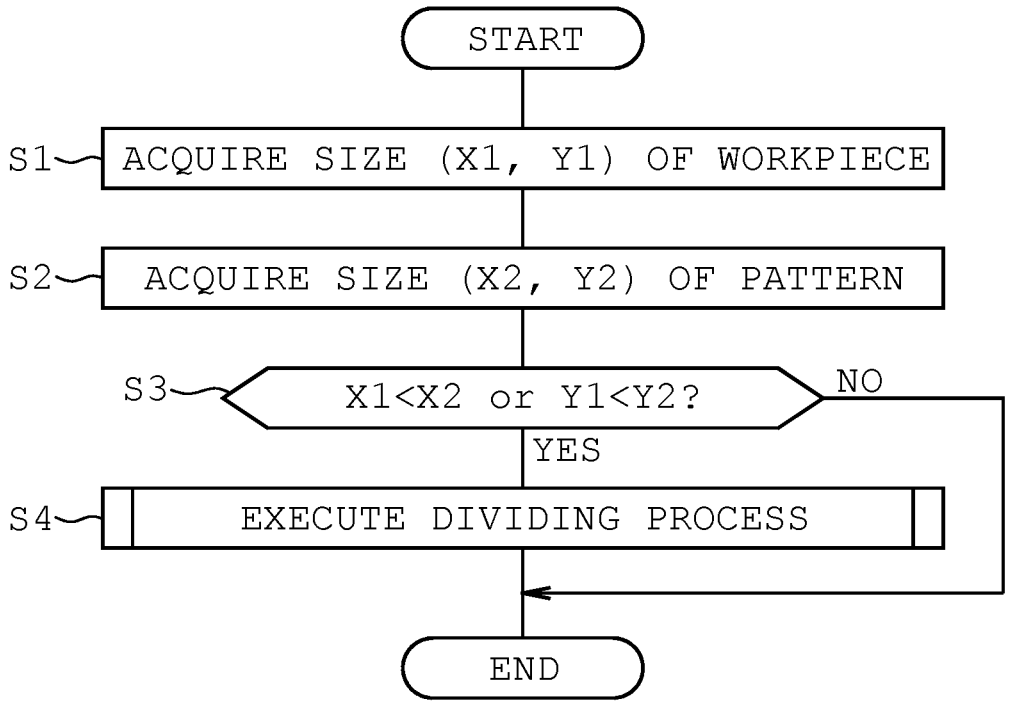
FIG. 5 is a flowchart illustrating a processing procedure of size judgement executed by a control apparatus.

Next, operation of the configuration will be described with reference to FIGS. 5 to 12. A flowchart of FIG. 5 illustrates a processing procedure of the size judgement executed by the control circuit 29 when the user operates the operation switches 20 to select the original pattern F to instruct the generating process of the cut data. In step S1, the size of one workpiece W, in this case, the data indicating that the horizontal and vertical dimensions are X1 and Y2, respectively, is acquired. In step S2, the size of the selected original pattern F, in this case, the data indicating that the horizontal and vertical dimensions are X2 and Y2, respectively, is acquired.

In the next step S3, whether the size X2 of the original pattern F in the horizontal direction is larger than the size X1 of the workpiece W in the horizontal direction or whether the size Y2 of the original pattern F in the vertical direction is larger than the size Y1 of the workpiece W in the vertical direction is judged. If at least one of the horizontal direction and the vertical direction of the original pattern F is larger than the size of the workpiece W (Yes in step S3), a dividing process of dividing the original pattern F into plural divided patterns D is executed in step S4. The dividing process is executed by, for example, arranging the center points of the original pattern F in the vertical and horizontal directions to coincide with the center point of the entire area A provided with the workpieces W and setting the boundaries between the workpieces W as the dividing lines P as described above (see FIG. 3B). If both the horizontal and vertical sizes of the original pattern F fall within the size of the workpiece W (No in step S3), the process ends, and the normal cut data generating process is executed although not illustrated.

Here, when the original pattern F of the "star" is divided into four divided patterns D1 to D4 as illustrated for example in FIGS. 3A and 3B, the divided patterns D1 to D4 are cut from the workpiece W, and then the cut objects are joined. In this case, it is preferable to provide each cut object with a joining margin (glue margin) for attachment when the workpiece W is, for example, paper. Providing the cut objects with the joining margins allows to readily perform the joining work, and the convenience is increased. Therefore, in the present embodiment, the control circuit 29 executes a margin adding process of adding the margins M as joining margins to the divided patterns D1 to D3 as illustrated in FIG. 4. Hereinafter, processes related to the addition of the margins M executed by the control circuit 29 will be described with reference to FIGS. 8 to 13, based on the example of the original pattern F of the "star".

Figure 8:
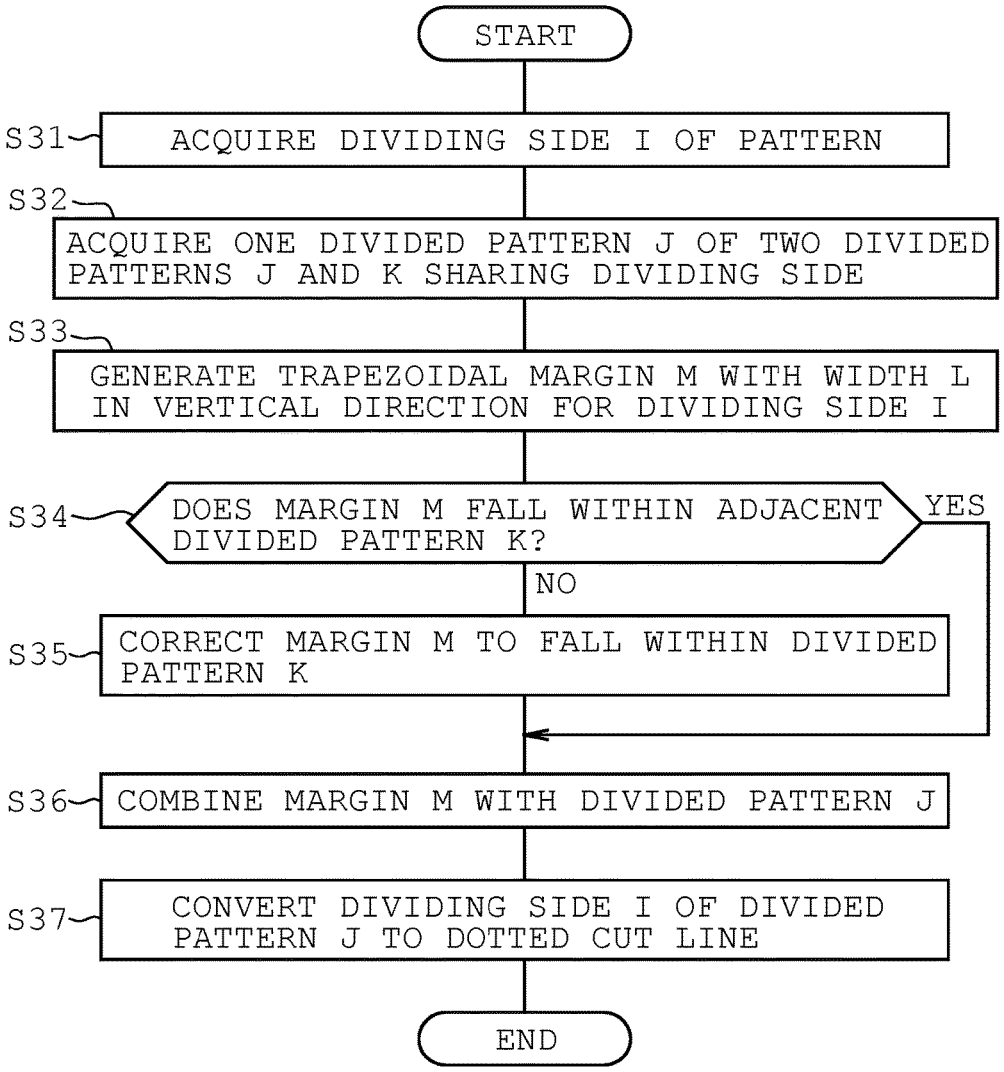
FIG. 8 is a flowchart illustrating a processing procedure of margin addition executed by the control apparatus.
Figure 9A:
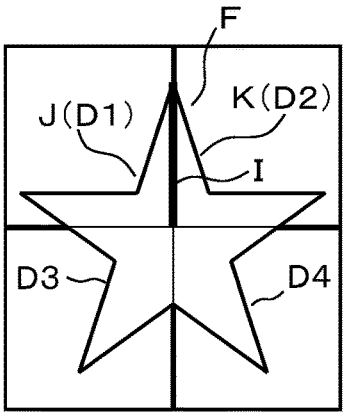
FIG. 9A is a diagram for explaining a margin adding method (part 1).
Figure 9B:
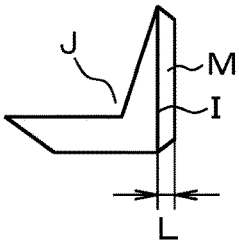
FIG. 9B is a diagram for explaining the margin adding method (part 2).
Figure 9C:
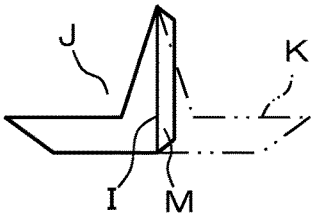
FIG. 9C is a diagram for explaining the margin adding method (part 3).
Figure 9D:
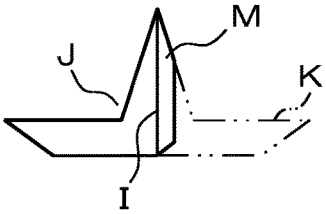
FIG. 9D is a diagram for explaining the margin adding method (part 4).
Figure 9E:
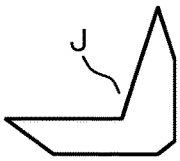
FIG. 9E is a diagram for explaining the margin adding method (part 5).
Figure 9F:
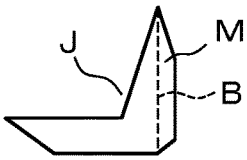
FIG. 9F is a diagram for explaining the margin adding method (part 6).
Figure 10:
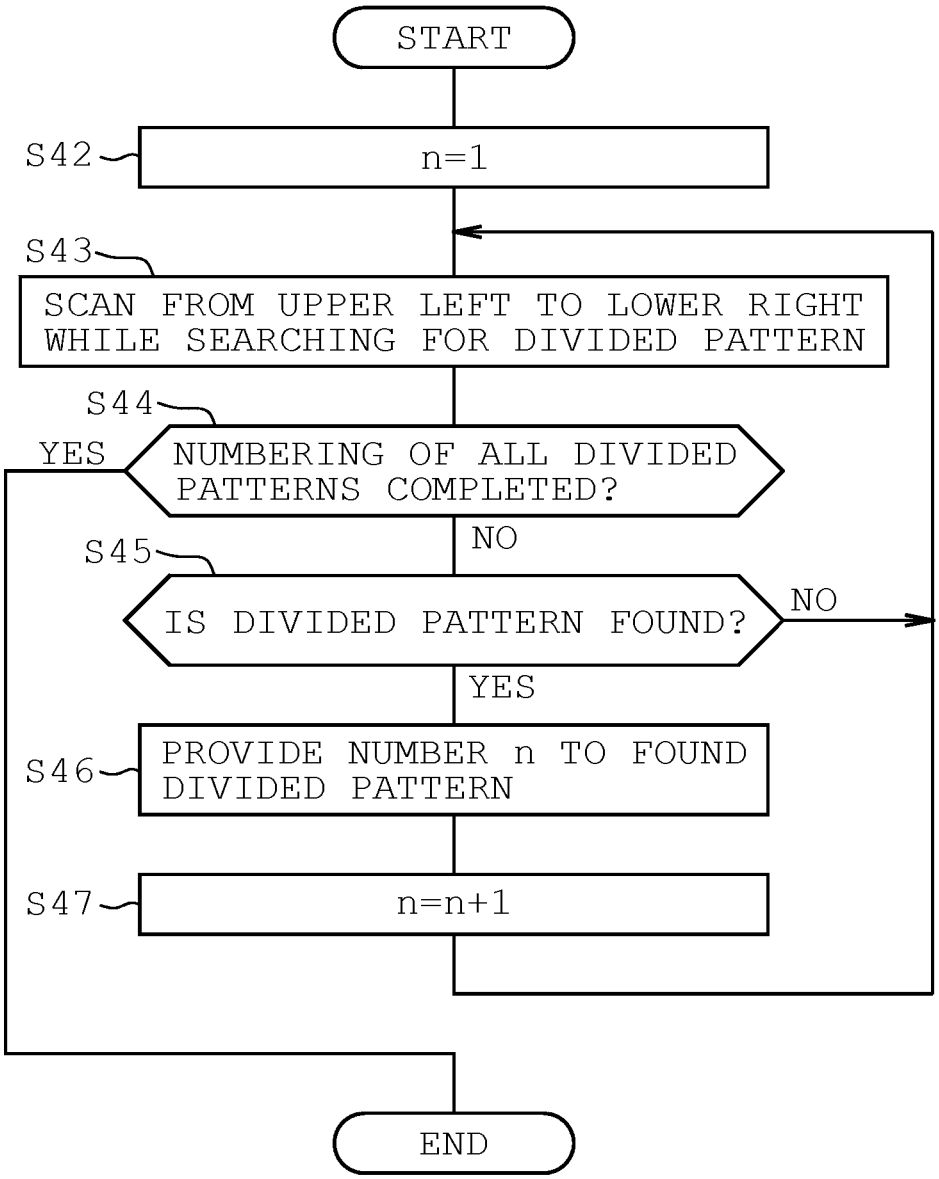
FIG. 10 is a flowchart illustrating a processing procedure of numbering of the divided patterns for adding the margins executed by the control apparatus.
Figure 12:
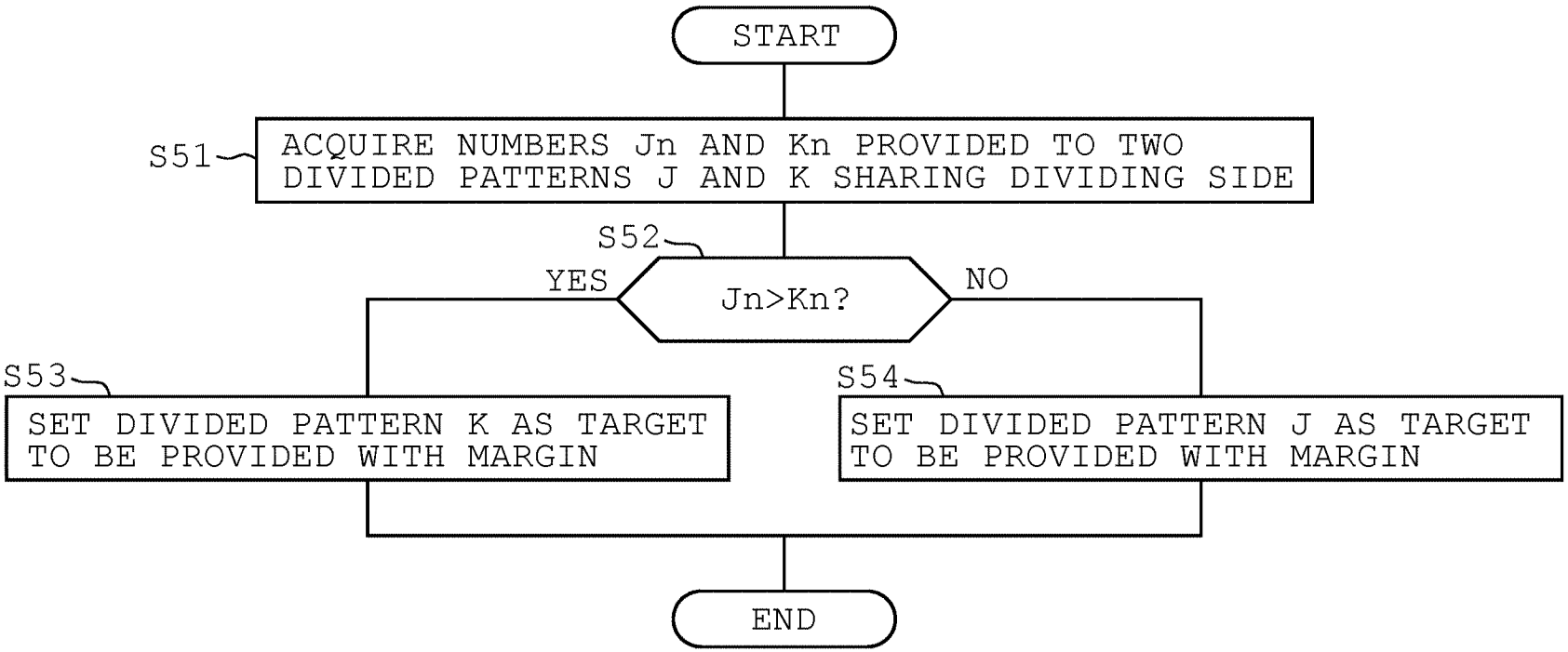
FIG. 12 is a flowchart illustrating a processing procedure of setting the divided patterns to be provided with the margins.
Figure 13:
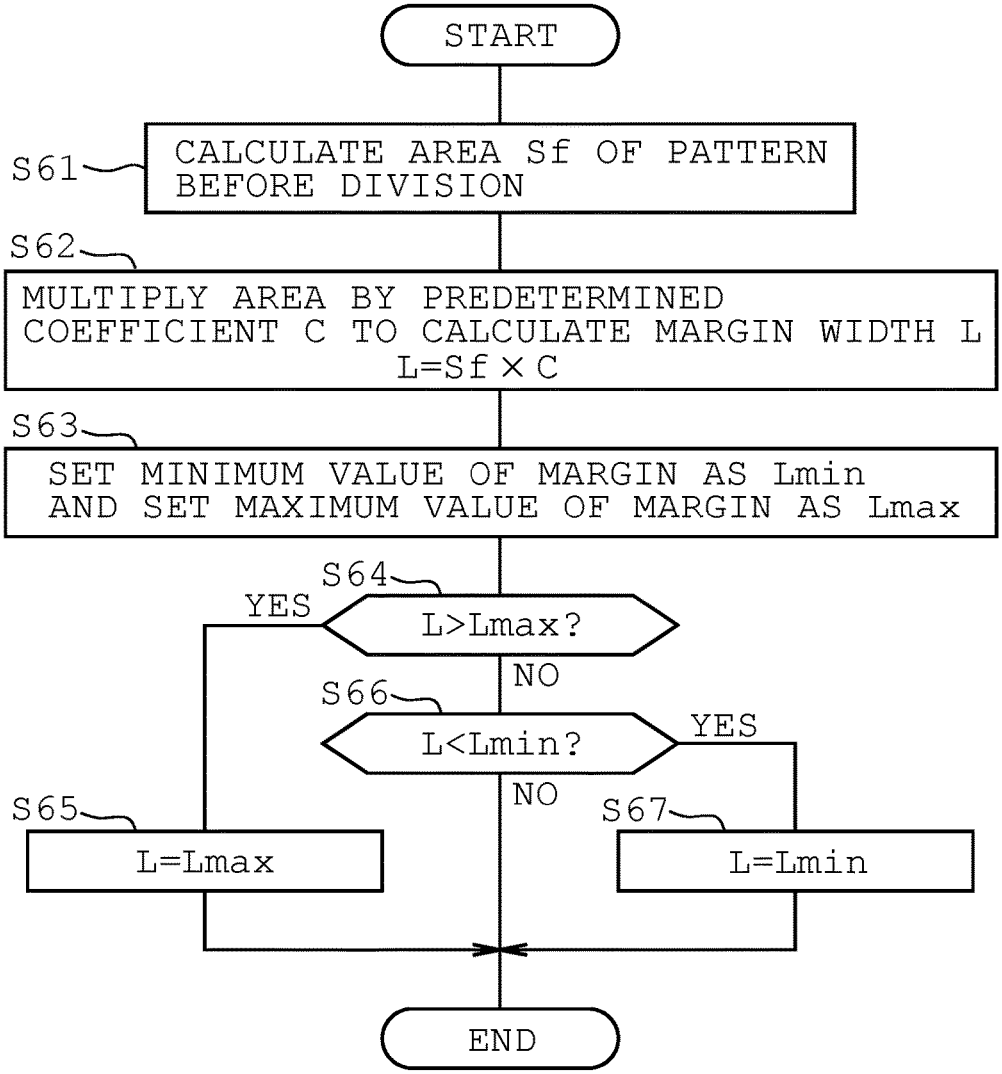
FIG. 13 is a flowchart illustrating a processing procedure of setting a margin width executed by the control apparatus.

A flowchart of FIG. 8 illustrates a processing procedure of adding the margin M executed by the control circuit 29. A flowchart of FIG. 10 illustrates a procedure of a process of numbering each of the divided patterns D for determining the divided pattern D to be provided with the margin M executed by the control circuit 29. A flowchart of FIG. 12 illustrates a processing procedure of setting the divided pattern to be provided with the margin M. A flowchart of FIG. 13 illustrates a procedure of a setting process of the width dimension L of the margin M executed by the control circuit 29. The process of adding the margin M will be described first with reference to FIGS. 8 and 9A to 9F.

In FIG. 8, a dividing side I of the original pattern F is first acquired in step S31. In this case, a dividing line between a divided pattern J (D1) and a divided pattern K (D2) is the dividing side I as illustrated in FIG. 9A. In step S32, a shape of one divided pattern J to be provided with the margin M of the divided patterns J and K adjacent to each other sharing the dividing side I is acquired. In this case, regarding which one of the divided patterns J and K adjacent to each other is to be provided with the margin M, one of the divided patterns J and K with a smaller number is provided with the margin M according to the flowcharts of FIGS. 10 and 12 described later.

In step S33, a trapezoidal margin M with the width dimension L in the direction perpendicular to the direction of the extension of the dividing side I is generated for the dividing side I of the divided pattern J. FIG. 9B illustrates the dividing side I of the divided pattern J provided with the margin M. In the present embodiment, the margin M is provided in a trapezoidal shape in which an end portion is, for example, a side slanted by 45 degrees. The width dimension L of the margin M in this case is set according to the flowchart of FIG. 13 described later. In the next step S34, whether the added margin M falls within (or coincides with) the inside area of the adjacent divided pattern K is judged. If the margin M falls within the inside area of the adjacent divided pattern K (Yes in step S34), the process proceeds to step S36.

On the other hand, the added margin M may not fall within the inside area of the adjacent divide pattern K and may stick out. In the example of FIG. 9C, an upper end part of the margin M sticks out of the shape of the divided pattern K (sharp part with an acute angle). In this way, if the margin M does not fall within the inside area of the adjacent divided pattern K (No in step S34), the shape of the margin M is corrected in step S35 so that the shape falls within the inside area of the adjacent divided pattern K, or in this case, the shape coincides with the shape of the divided pattern K. More specifically, the part sticking out from the adjacent divided pattern K is deleted. FIG. 9D illustrates the shape of the margin M after the correction.

Subsequently, the margin M is added to the divided pattern J in step S36, and the pattern has a shape of a combination of the margin M and the divided pattern J. This is illustrated in FIG. 9E. In step S37, boundary data for forming a mark indicating the boundary B between the divided pattern J and the margin M is generated. This is illustrated in FIG. 9F. Although not illustrated in detail, the process is executed for all of the dividing sides I, and the margin adding process is finished. As illustrated in FIG. 4, the margin M is added to each of the divided patterns D1 to D3 for the original pattern F in the shape of the "star".

The control circuit 29 generates cut data for some of the divided patterns D1 to D4 provided with the margin M. In this case, based on the boundary data, a dotted line for cutting at the boundary B can be provided to the workpiece W, that is, intermittent incisions can be provided, or the boundary B can be drawn by a pen. In this way, the control circuit 29 can generate the cut data while automatically adding the margins M as joining margins to the divided patterns D.

The flowchart of FIG. 10 illustrates a processing procedure of providing a number to each divided pattern to set one of the divided patterns J and K adjacent to each other to be provided with the margin M prior to the process of adding the margin M (FIG. 8). The process will be explained with reference also to FIGS. 11A and 11B. In step S42, a parameter n is set to 1. In step S43, each workpiece W included in the entire area A of FIG. 3B is scanned to search for the divided pattern. In the search, the divided patterns in the workpieces W from left to right are sequentially scanned from top to bottom.

In step S44, whether numbering of all of the divided patterns is completed is judged. If the numbering is not completed yet (No in step S44), the process proceeds to step S45, and whether the divided pattern is found is judged. If the divided pattern is found (Yes in step S45), a number n is provided to the found divided pattern in step S46. In step S47, the value of n is incremented by 1, and the process returns to step S43 to search for the next search pattern. The process also returns to step S43 if the divided pattern is not found in step S45 (No in step S45). The numbering of the divided patterns is sequentially executed, and if the numbering of all of the divided patterns is completed (Yes in step S44), the process ends.

Figure 11A:
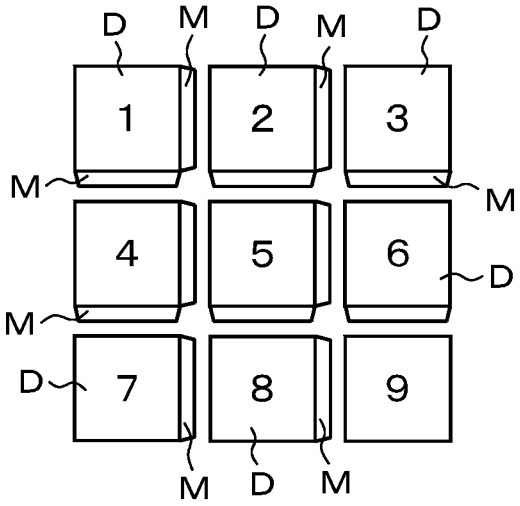
FIG. 11A is a diagram for explaining a method of numbering of the divided patterns (part 1).
Figure 11B:
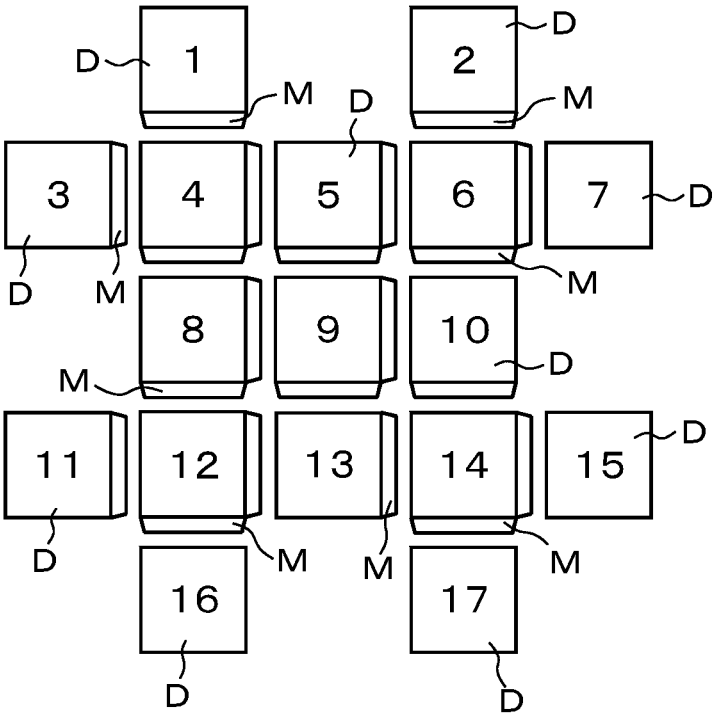
FIG. 11B is a diagram for explaining the method of numbering of the divided patterns (part 2).

As a result of the process, when, for example, nine divided patterns in total are aligned in three vertical rows and three horizontal rows as illustrated in FIG. 11A, numbers 1, 2, and 3 are sequentially provided from the left in the upper row, numbers 4, 5, and 6 are sequentially provided from the left in the middle row, and numbers 7, 8, and 9 are sequentially provided from the left in the lower row. Even when, for example, seventeen divided patterns are arranged in a partially protruded irregular form as illustrated in FIG. 11B, numbers 1, 2, 3, . . . are sequentially provided from the left in the upper row in the same way.

The flowchart of FIG. 12 illustrates a processing procedure of setting the divided pattern to be provided with the margin M executed by the control circuit 29 after the numbering of each of the divided patterns D. In the present embodiment, the margin M is added to one of the adjacent divided patterns J and K with the smaller number provided in the numbering process. More specifically, in step S51, numbers Jn and Kn provided to the two divided patterns J and K sharing the dividing side I are acquired.

In the next step S52, whether Jn is larger than Kn is judged. If Jn is larger than Kn (Yes in step S52), the divided pattern K is set as the target to be provided with the margin M in step S53. If Jn is not larger than (smaller than) Kn (No in step S52), the divided pattern J is set as the target to be provided with the margin M in step S54, and the process ends. FIGS. 11A and 11B illustrate the parts of the divided patterns to be provided with the margins M.

The flowchart of FIG. 13 illustrates a procedure of a setting process of the width dimension L of the margin M executed by the control circuit 29 prior to the process of adding the margin M (FIG. 8). In step S61, an area Sf ($cm^2$) of the original pattern F before the division is calculated. In step S62, the area S ($cm^2$) is multiplied by a coefficient C to calculate the width dimension L (cm). More specifically, the width dimension L is obtained by a formula L=Sf*C. The coefficient C is, for example, 1/1000, and the width dimension L is 1 cm when, for example, the area of the original pattern is 1000 $cm^2$.

In step S63, a minimum value Lmin and a maximum value Lmax of the width dimension of the margin M are set. The minimum value Lmin is, for example, 3 mm to 5 mm. The maximum value Lmax is, for example, 1 cm to 2 cm. In step S64, whether the calculated width dimension L is greater than the maximum value Lmax is judged. If the width dimension L is greater than the maximum value Lmax (Yes in step S64), the width dimension L is set to the maximum value Lmax in step S65.

On the other hand, if the width dimension L is not larger than the maximum value Lmax (No in step S64), whether the width dimension L is smaller than the minimum value Lmin is judged in step S66. If the width dimension L is smaller than the minimum value Lmin (Yes in step S66), the width dimension L is set to Lmin in step S67. In other cases (No in step S66), the calculated width dimension L is directly used, and the process ends. This allows to set the width dimension L with a proper margin M corresponding to the area Sf of the original pattern F and allows to prevent the width dimension L from becoming too large or too small. Note that the width dimension L of the margin M may be a fixed value.

Figure 6:
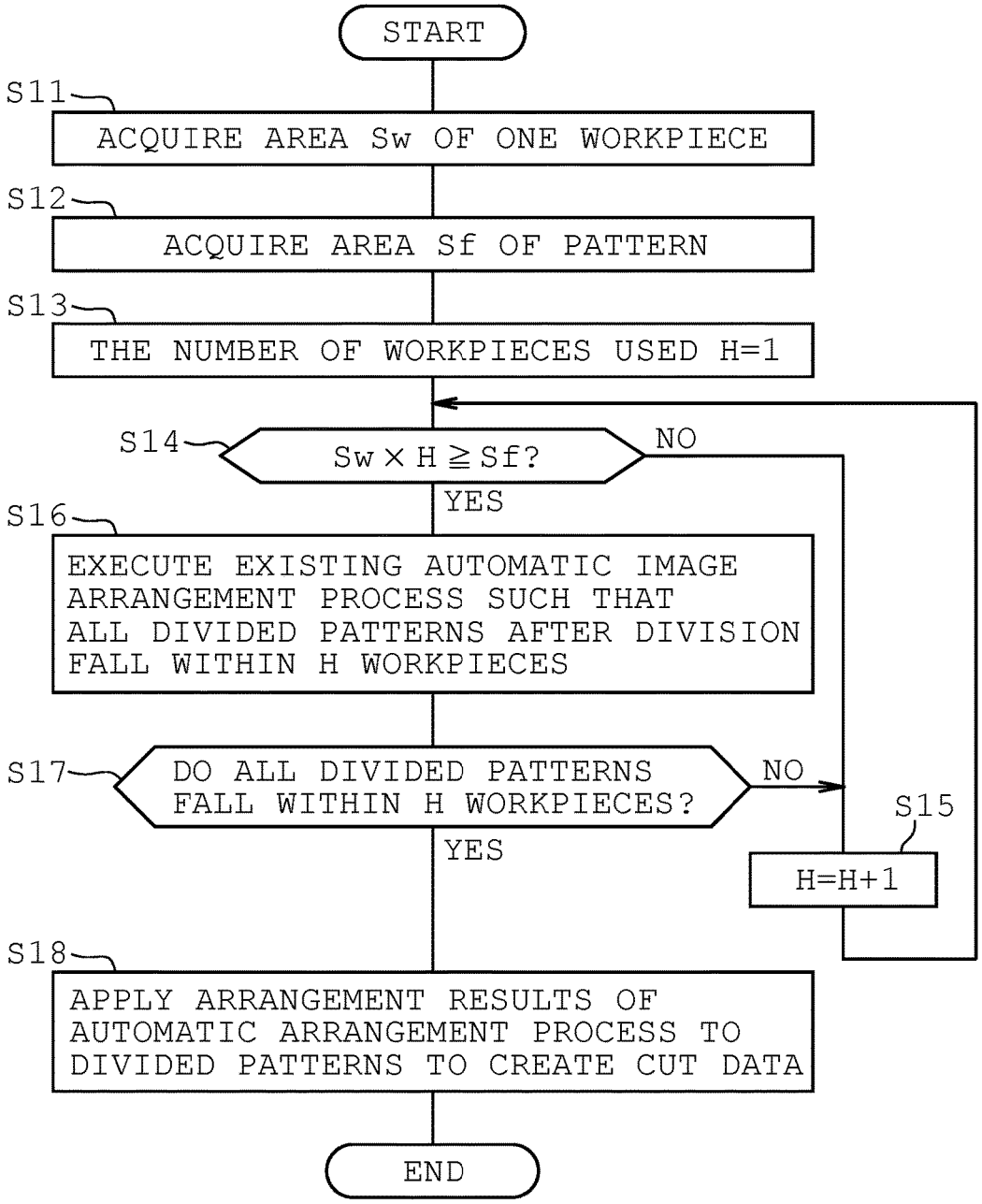
FIG. 6 is a flowchart illustrating a processing procedure of rearrangement of the divided patterns executed by the control apparatus.
Figure 7A:
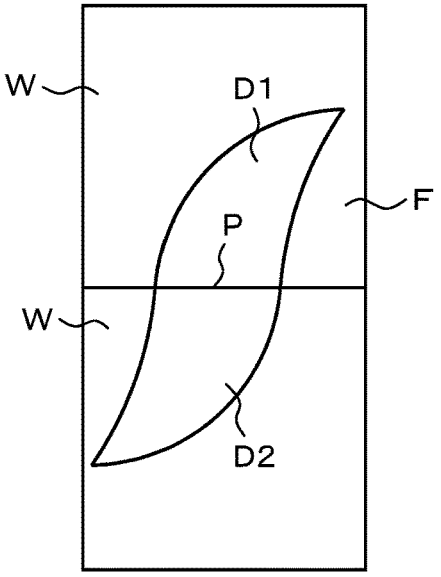
FIG. 7A is a diagram for explaining a rearranging process of the divided patterns (part 1).
Figure 7B:
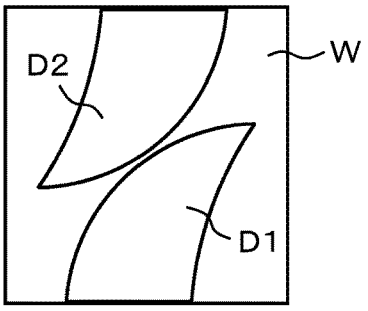
FIG. 7B is a diagram for explaining a rearranging process of the divided patterns (part 2).
Figure 7C:
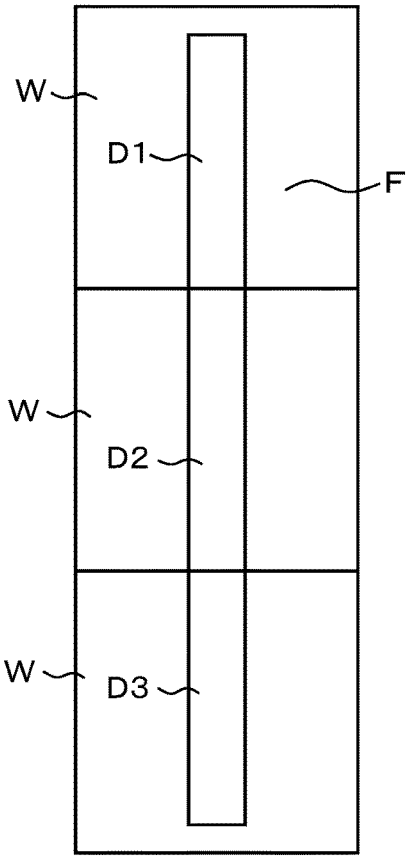
FIG. 7C is a diagram for explaining a rearranging process of the divided patterns (part 3).

The flowchart of FIG. 6 illustrates a procedure of a rearrangement process of the divided patterns D executed by the control circuit 29 after the original pattern F is divided into the plural divided patterns D in the dividing process. Details of the process will be described with reference also to FIGS. 7A to 7D. Here, an S-curve streamline original pattern F as illustrated in FIG. 7A and an elongated strip-shaped original pattern F as illustrated in FIG. 7C will be explained as examples of patterns different from the "star". More specifically, an area Sw of one workpiece W is acquired in step S11. The area Sw can be obtained by Sw=X1×Y1.

In step S12, an area Sf of the original pattern F is acquired. In step S13, a parameter H indicating the number of workpieces W used is set to 1. In step S14, whether the area Sf of the original pattern F is equal to or smaller than an area obtained by multiplying the area Sw of one workpiece W by the parameter H, that is, whether the area Sf of the original pattern F falls within the area of H workpieces W, is determined. If the area Sf of the original pattern F is larger than the area obtained by multiplying the area Sw of the workpiece W by the parameter H (No in step S14), the value of the parameter H is incremented by 1 in step S15, and the process returns to step S14.

If it is judged that the area Sf of the original pattern F is equal to or smaller than the area obtained by multiplying the area Sw of the workpiece W by the parameter H (Yes in step S14), a process of rearranging the divided patterns D is executed in step S16 such that all of the divided patterns D after the dividing process fall within the H workpieces W, that is, all of the divided patterns D after the dividing process are arranged on any of the H workpieces W without overlapping with each other. The process is realized by, for example, an automatic image arrangement process using well-known OpenCV. In step S17, whether all of the divided patterns D fall within the H workpieces W is judged. If all of the divided patterns D do not fall within the H workpieces W (No in step S17), the value of the parameter H is incremented by 1 in step S15, and the process from step S14 is repeated.

Figure 7D:
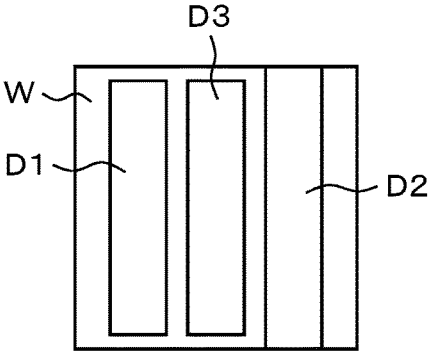
FIG. 7D is a diagram for explaining a rearranging process of the divided patterns (part 4).

On the other hand, if all of the divided patterns D fall within the H workpieces W (No in step S17), the arrangement results of the automatic arrangement process of step S16 are applied to the divided patterns D to generate cut data in step S18. In the example of the original pattern F of FIG. 7A, the original pattern F is divided into two divided patterns D1 and D2, and the two divided patterns D1 and D2 are rearranged to fall within one workpiece W in the automatic arrangement process as illustrated in FIG. 7B. Similarly, the original pattern F is divided into three divided patterns D1, D2, and D3 in the example of the original pattern F of FIG. 7C, and the three divided patterns D1, D2, and D3 are rearranged to fall within one workpiece W in the automatic arrangement process as illustrated in FIG. 7D.

According to the process, the control circuit 29 generates cut data for cutting two or three divided patterns D from one workpiece W, for example. The cut data can be used to obtain two cut objects by cutting the divided patterns D1 and D2 from one workpiece W in the example of FIG. 7B. Three cut objects can be obtained by cutting the divided patterns D1, D2, and D3 from one workpiece W in the example of FIG. 7D. The cut objects of the divided patterns D can be combined and joined to obtain a cut object of one large pattern corresponding to the original pattern F. When the margins M are added to the divided patterns D as illustrated in FIGS. 8 and 10 to 13, the shapes and the areas of the divided patterns D after the addition of the margins M can be used to execute the automatic arrangement process of step S16, for example.

According to the present embodiment, the following operation and effect can be obtained. More specifically, when the control circuit 29 generates the cut data, the control circuit 29 identifies the size of the original pattern F and judges whether the size is larger than the size of the workpiece W. If the size of the original pattern F is larger than the size of the workpiece W, the original pattern F is divided into the plural divided patterns D, and the cut data for cutting each of the divided patterns D is generated.

Therefore, the divided pattern D can be cut from the plural workpieces W, and the cut objects of the divided patterns D1 to D4 can be combined and joined to obtain the cut object with one large pattern corresponding to the original pattern F. In this way, the present embodiment can attain an excellent effect of generating the cut data that allows to cut the large pattern F exceeding the size of one workpiece W, unlike in the conventional techniques.

In this case, the control circuit 29 determines whether at least one of the plural divided patterns D divided in the dividing process falls within one workpiece W along with another divided pattern D in the present embodiment and generates cut data for cutting the divided patterns D from one workpiece W if the control circuit 29 determines that at least one of the divided patterns D falls within one workpiece W along with another divided pattern D. As a result, plural divided patterns D are rearranged in one workpiece W, and the number of workpieces W in cutting the divided patterns D can be reduced. In addition, the waste in cutting the divided patterns D from the workpiece W can be reduced, and efficient cutting work can be performed.

Particularly, the cut data is generated while the margins M as joining margins are automatically added to the divided pattern D in the present embodiment. Therefore, the joining work of the cut objects of the divided pattern D can be readily performed, and this is more effective. In the margin adding process, the margin M shaped to fall within or coincide with the shape of the adjacent part in the other adjacent divided pattern D is added. This prevents the part of the margin M from sticking out from the pattern and allows the joint to look good. The boundary data is also generated for the divided patterns D provided with the margins M. Therefore, the boundary B can be drawn as a mark, or a mark can be put along the boundary B. This can further facilitate the joining work and the positioning work during the joining work.

(2) Second to Fourth Embodiments and Other Embodiments

Figure 14:
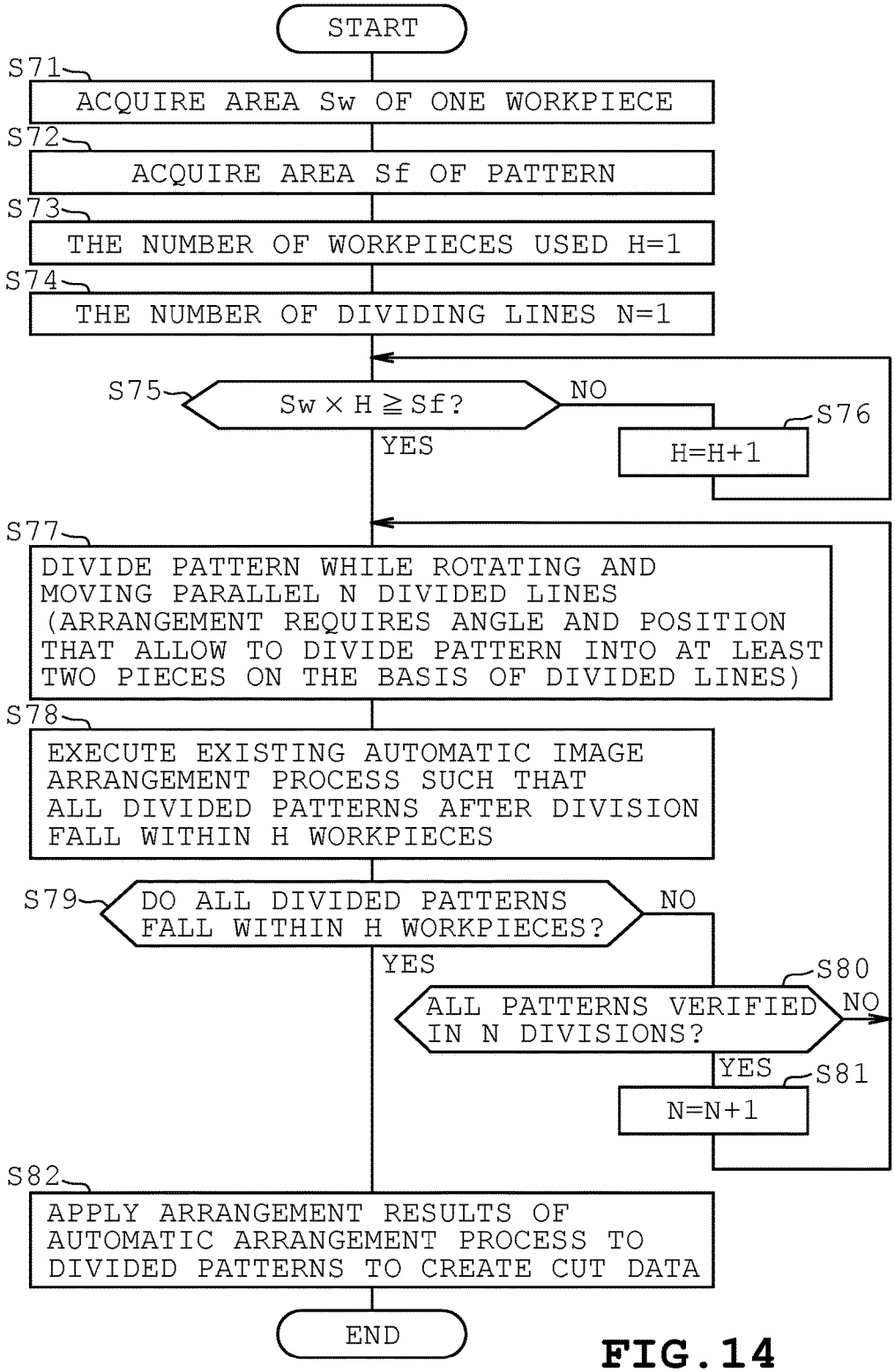
FIG. 14 is a flowchart illustrating a second embodiment and illustrating a procedure of a dividing process of a pattern.
Figure 15A:
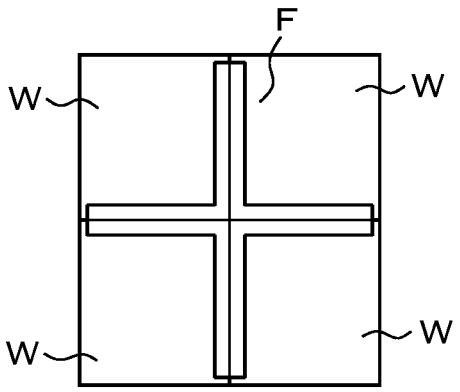
FIG. 15A is a diagram for explaining a rearranging process of the divided patterns (part 1).
Figure 15B:
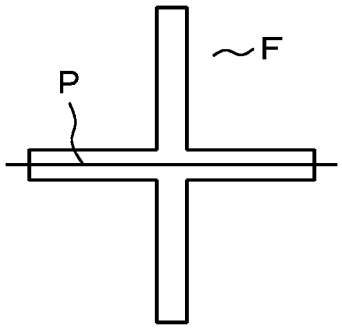
FIG. 15B is a diagram for explaining a rearranging process of the divided patterns (part 2).

FIGS. 14, 15A, and 15B illustrate a second embodiment of the present disclosure. In each embodiment described below, new illustration and detailed explanation are not provided for the parts common to the first embodiment. The same reference signs are also used, and points different from the first embodiment will be mainly described. In the second embodiment, the difference from the first embodiment is as follows.

In the second embodiment, the control circuit 29 functions as a smallest number calculating section configured to execute a smallest number calculating process of obtaining the smallest number of workpieces W necessary to cut the original pattern F based on the area Sf of the original pattern F and the area Sw of the workpiece W. When executing the dividing process, the control circuit 29 searches for a divided state of the divided patterns D that can fall within the smallest number of workpieces W while changing the positions and the number of dividing lines P with respect to the original pattern F.

A flowchart of FIG. 14 illustrates a procedure of a dividing process of the original pattern F executed by the control circuit 29 when the control circuit 29 judges that the size of the original pattern F is larger than the size of the workpiece W in the cut data generating process. Here, an example of a cross-shaped original pattern F as illustrated in FIG. 15A will be explained as a pattern different from the first embodiment. More specifically, the area Sw of one workpiece W is acquired in step S71. In step S72, the area Sf of the original pattern F is acquired. In step S73, the parameter H indicating the number of workpieces W used is set to 1. In step S74, a parameter N indicating the number of dividing lines P is set to 1.

In step S75, whether the area Sf of the original pattern F is equal to or smaller than the area obtained by multiplying the area Sw of one workpiece W by the parameter H, that is, whether the area Sf of the original pattern F falls within the area of the H workpieces W, is judged. If the area Sf of the original pattern F is larger than the area obtained by multiplying the area Sw of the workpiece W by the parameter H (No in step S75), the value of the parameter H is incremented by 1 in step S76, and the process returns to step S75.

If it is judged that the area Sf of the original pattern F is equal to or smaller than the area obtained by multiplying the area Sw of the workpiece W by the parameter H (Yes in step S75), the original pattern F is divided while each of the N dividing lines P is rotated and moved parallel in step S77. In step S78, the divided patterns D are rearranged in the automatic image arrangement process using well-known OpenCV such that all of the divided patterns D after the division fall within the H workpieces W. In step S79, whether all of the divided patterns D fall within the H workpieces W is judged.

If not all of the divided patterns D fall within the H workpieces W (No in step S79), whether all of the patterns are verified in N divisions (N dividing lines P) is judged in step S80. If not all of the patterns are verified yet (No in step S80), the process from step S77 is repeated. If all of the patterns are verified, the parameter N indicating the number of dividing lines P is incremented by 1, and the process from step S77 is repeated.

Figure 15C:
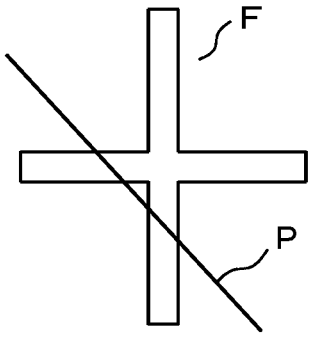
FIG. 15C is a diagram for explaining a rearranging process of the divided patterns (part 3).
Figure 15D:
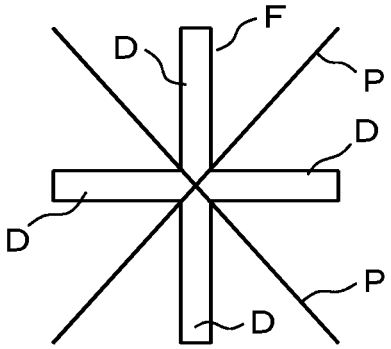
FIG. 15D is a diagram for explaining a rearranging process of the divided patterns (part 4).

If all of the divided patterns D fall within the H workpieces W by repeating the process (Yes in step S79), the arrangement results of the automatic arrangement process of step S78 are applied to the divided patterns D to generate cut data in step S82. In the example of the original pattern F of FIG. 15A, the divided patterns D cannot be arranged within one workpiece W even if the dividing line P is rotated or moved parallel in various ways as illustrated in FIGS. 15B and 15C when the number of dividing lines P is one (N=1). On the other hand, two dividing lines P orthogonal to each other diagonally arranged at 45 degrees as illustrated in FIG. 15D can be used to divide the original pattern F into four divided patterns D. In this case, all of the four divided patterns D can be placed within one workpiece W as illustrated in FIG. 15E.

Figure 15E:
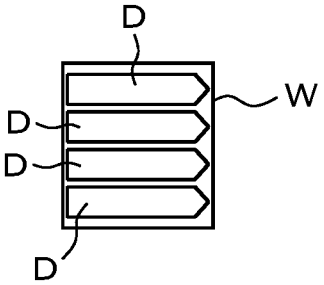
FIG. 15E is a diagram for explaining a rearranging process of the divided patterns (part 5).

As a result of the process, the control circuit 29 generates, for example, cut data for cutting four divided patterns D from one workpiece W in the example of FIG. 15E. The cut data can be used to cut the divided patterns D from one workpiece W to obtain four cut objects. The cut objects of the divided patterns D can be combined and joined to obtain a cut object of one large pattern corresponding to the original pattern F. Therefore, the same effects as in the first embodiment can also be obtained in the second embodiment. Furthermore, the number of workpieces W necessary for cutting all of the divided patterns D can be minimized, and this is more effective.

In the second embodiment, when the margins M are added to the divided patterns D as illustrated in FIGS. 8 and 10 to 13, the shapes and the areas of the divided patterns D after the addition of the margins M can also be used to execute the automatic arrangement process of step S78, for example.

Figure 16:
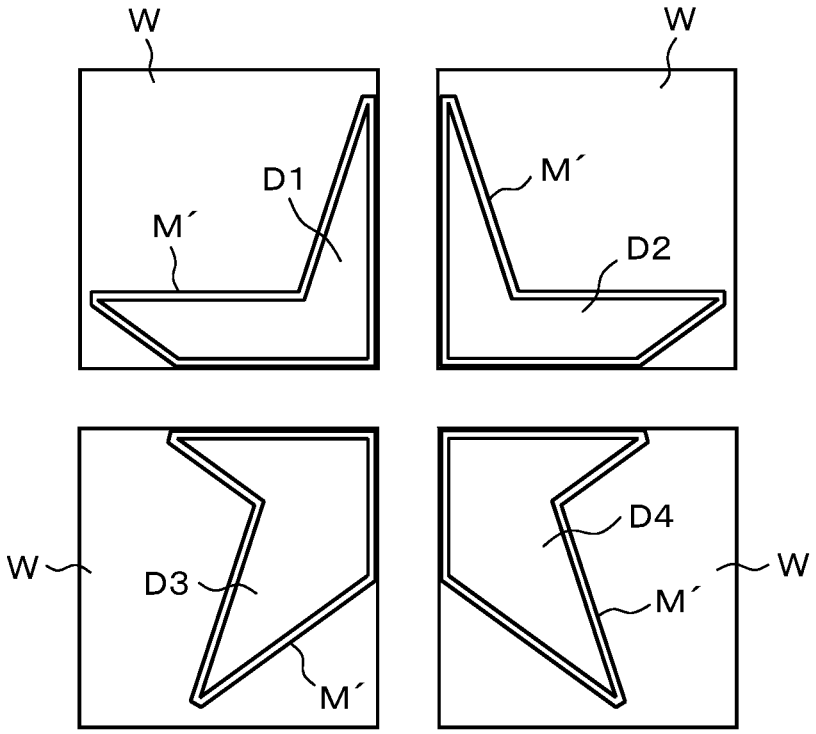
FIG. 16 illustrates a third embodiment and illustrates the divided patterns provided with margins as seam allowances.

Next, a third embodiment will be explained with reference to FIG. 16. In the first embodiment, the margin M as a joining margin (glue margin) is added to the part of the divided pattern D adjacent to another divided pattern D through the dividing side I. In contrast, margins M' as seam allowances are added to the entire surroundings of the divided patterns D1 to D4 in all of the divided patterns D1 to D4 related to the original pattern F of the "star" when the workpiece W is a cloth in the third embodiment.

In this case, the width dimension L of the margin M' may also be set according to the area of the original pattern F, or the width dimension may be fixed regardless of the size of the original pattern F. This can facilitate the work of sewing and joining the cut objects regarding the divided patterns D1 to D4 cut from the cloth or the work of sewing the cut objects on another large cloth to form one pattern.

Figure 17:
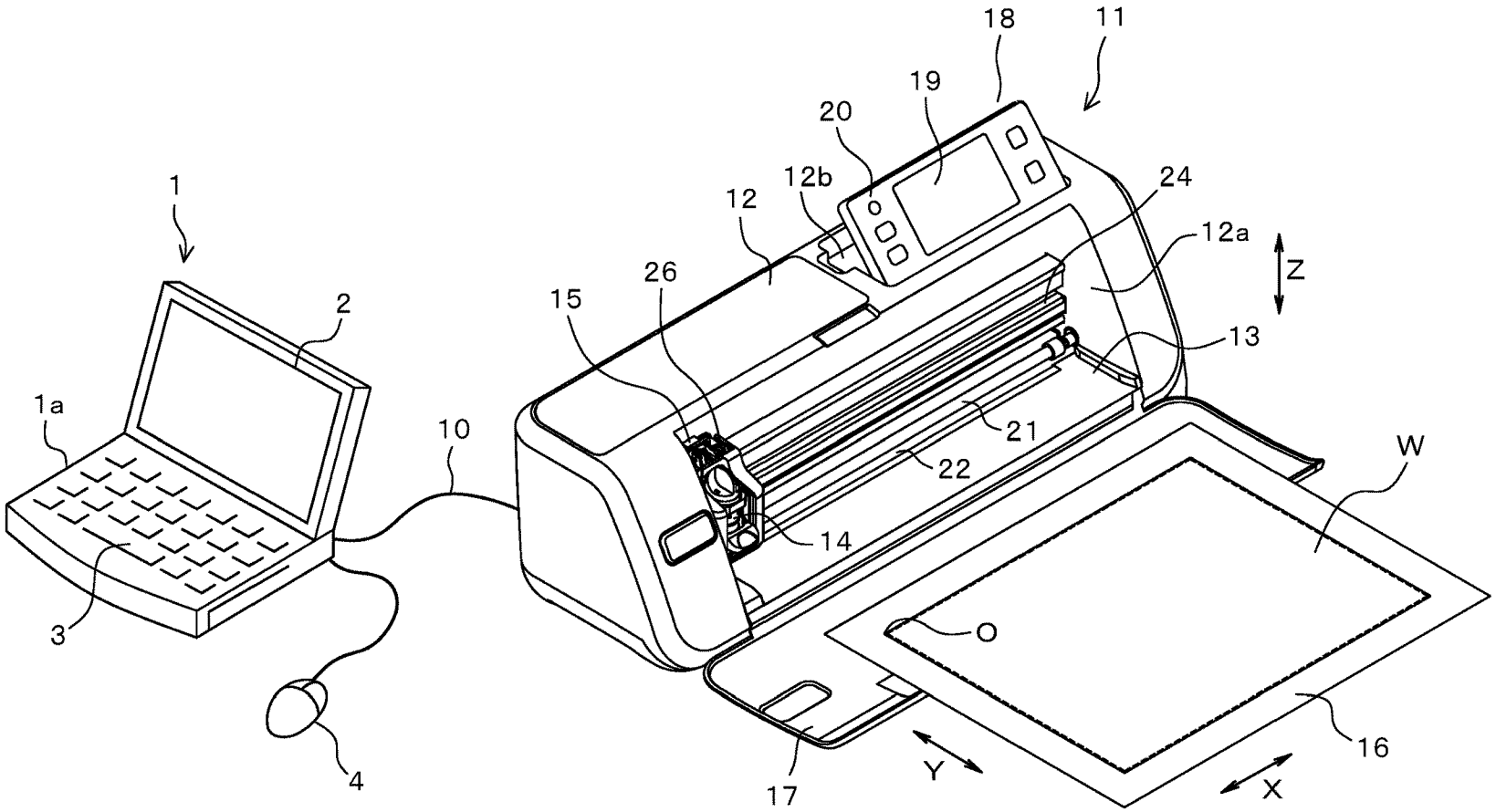
FIG. 17 illustrates a fourth embodiment and illustrates an appearance of the cut data generating apparatus and the cutting apparatus.
Figure 18:
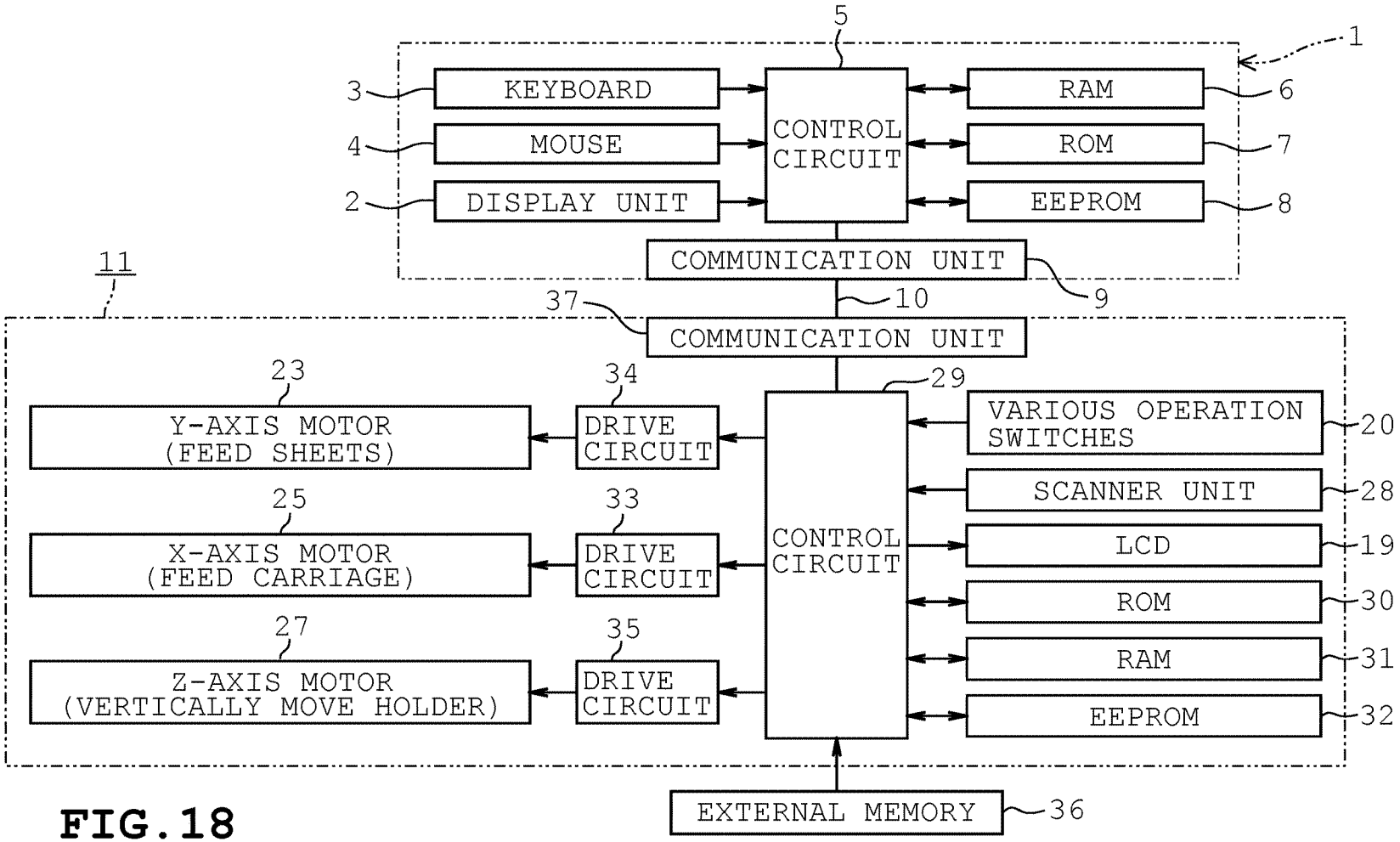
FIG. 18 is a block diagram schematically illustrating an electrical configuration of the cut data generating apparatus and the cutting apparatus.

FIGS. 17 and 18 illustrate a fourth embodiment of the present disclosure. FIG. 17 illustrates an external configuration of a cut data generating apparatus 1 and the cutting apparatus 11 according to the present embodiment, and FIG. 18 schematically illustrates an electrical configuration of the apparatuses. The cut data generating apparatus 1 according to the present embodiment is, for example, a personal computer and is connected to the cutting apparatus 11 through a communication cable 10. The cutting apparatus 11 is an apparatus configured to cut the workpiece W, such as paper and sheet, according to the cut data.

The cut data generating apparatus 1 is a personal computer configured to execute the cut data generating program. As illustrated in FIG. 17, the cut data generating apparatus 1 includes a display unit (liquid crystal display) 2, a keyboard 3, and a mouse 4 on a computer body 1*a*. As illustrated in FIG. 18, the computer body 1*a* is provided with: a control circuit 5 mainly including a CPU; and a RAM 6, a ROM 7, an EEPROM 8, a communication unit 9, and the like connected to the control circuit 5.

The display unit 2 displays necessary information, such as a message for the user. The keyboard 3 and the mouse 4 are operated by the user, and the operation signals are input to the control circuit 5. The RAM 6 temporarily stores necessary information according to the program executed by the control circuit 5. The ROM 7 stores the cut data generating program and the like. The EEPROM 8 stores data (such as outline data) of plural different patterns for which the cut data is to be generated, the generated cut data, and the like. A scanner not illustrated can also be connected to the cut data generating apparatus 1 to input the data of the patterns.

The communication unit 9 is configured to transmit and receive data and the like to and from an external device. In the present embodiment, the communication unit 9 transmits the cut data generated by the cut data generating apparatus 1 to a communication unit 37 of the cutting apparatus 11 through the communication cable 10. The communication unit 9 of the cut data generating apparatus 1 and the communication unit 37 of the cutting apparatus 11 may be connected through wireless communication. Although not illustrated, the cut data may be transferred between the cut data generating apparatus 1 and the cutting apparatus 11 through a removable external storage unit, such as a USB memory, or through a network, such as the Internet.

In the present embodiment, the cut data generating apparatus 1 (control circuit 5) executes the cut data generating program to execute each process of the cut data generating apparatus configured to generate the cut data. In generating the cut data, the control circuit 5 executes the size identifying process of identifying the size of the original pattern F from the pattern data of the original pattern F and the size judging process of judging whether the identified size of the original pattern is larger than the size of the workpiece W. When the size of the original pattern F is smaller than the size of the workpiece W, the control circuit 29 executes the normal cut data generating process, that is, the process of generating the cut data for cutting the original pattern F from one workpiece W without executing the dividing process.

When the control circuit 5 judges that the size of the original pattern F is larger than the size of the workpiece W, the control circuit 5 executes the dividing process of using the dividing lines P to divide the original pattern F into plural divided patterns D smaller than the size of the workpiece W and then executes the cut data generating process of creating the cut data for cutting each of the divided patterns D. In the dividing process, the control circuit 5 further executes the determining process of determining whether at least one of the divided patterns D falls within one workpiece W along with another divided pattern D. When the control circuit 5 determines that at least one of the divided patterns falls within one workpiece along with another divided pattern, the control circuit 5 rearranges the plural divided patterns D with respect to the workpiece W and generates cut data for cutting the divided patterns D from one workpiece W in the cut data creating process. Therefore, the control circuit 5 functions as a size identifying section, a size judging section, a dividing section, and a cut data creating section and further functions as a determining section. The control circuit 5 also functions as a margin adding section configured to execute the margin adding process of adding the margins M to the divided patterns D. The control circuit 5 generates cut data including the added margins M.

Therefore, as in the first embodiment, the fourth embodiment can also obtain the excellent effect of generating the cut data that is for cutting the pattern in the predetermined shape from the workpiece W and that allows to cut a large pattern exceeding the size of one workpiece W. Furthermore, the number of workpieces W can be reduced when the pattern is divided. In addition, by providing the margin adding section, the cut data can be generated while the margins M as joining margins are automatically added to the divided patterns D.

Although the margins M are added to the divided patterns D in the embodiments, the margins M can be added as necessary. Although there is one type in the size of the workpiece (holding member) in the explanation of each of the embodiments, plural types of workpieces (holding members) may be combined to cut the divided patterns. Although the cut data generating apparatus is a cutting apparatus or a general-purpose personal computer in each of the embodiments, the cut data generating apparatus may be a special-purpose apparatus configured to generate the cut data. A scanner configured to read data of a shape from an original drawing may be connected to the cut data generating apparatus. In addition, the specific configuration of the cutting apparatus can be changed in various ways. The present disclosure is not limited to the embodiments, and the present disclosure can be appropriately changed and carried out without departing from the scope of the present disclosure.

In the embodiments described above, a single CPU may perform all of the processes. Nevertheless, the disclosure may not be limited to the specific embodiment thereof, and a plurality of CPUs, a special application specific integrated circuit ("ASIC"), or a combination of a CPU and an ASIC may be used to perform the processes.

The foregoing description and drawings are merely illustrative of the principles of the disclosure and are not to be construed in a limited sense. Various changes and modifications will become apparent to those of ordinary skill in the art. All such changes and modifications are seen to fall within the scope of the disclosure as defined by the appended claims.

I claim:

1. A cut data generating apparatus configured to generate cut data for a cutting apparatus comprising a cut mechanism to cut a pattern from a workpiece, the cut data generating apparatus comprising:

a controller, the controller being configured to control the cut data generating apparatus to:

identify a size of an original pattern to be cut;

judge whether the size of the original pattern identified is larger than a size of the workpiece;

divide the original pattern into plural divided patterns smaller than the size of the workpiece in case the size of the original pattern is larger than the size of the workpiece;

determine whether at least one of the plural divided patterns falls within one workpiece along with another divided pattern; and generate cut data for cutting the divided patterns from one workpiece in case at least one of the divided patterns falls within one workpiece along with another divided pattern.

2. The cut data generating apparatus according to claim 1, the controller being configured to further control the cut data generating apparatus to:

obtain a smallest number of workpieces necessary for cutting the original pattern based on an area of the original pattern and an area of the workpiece, divide the original pattern by searching for a divided state of the divided patterns that can fall within the smallest number of workpieces while changing position and a number of dividing lines for dividing the original pattern.

3. The cut data generating apparatus according to claim 1, the controller being configured to further control the cut data generating apparatus to:

add, to at least one of the divided patterns, a margin as a joining margin partially overlapping with another adjacent divided pattern, generate cut data for cutting the divided patterns which involve the at least one of the divided patterns provided with the margin.

4. The cut data generating apparatus according to claim 3, the controller being configured to further control the cut data generating apparatus to:

acquire a shape of an adjacent part overlapping with the margin in the another adjacent divided pattern, add the margin shaped to fall within the acquired shape of the adjacent part.

5. The cut data generating apparatus according to claim 3, the controller being configured to further control the cut data generating apparatus to:

acquire a shape of an adjacent part overlapping with the margin in the another adjacent divided pattern, add the margin shaped to coincide with the acquired shape of the adjacent part.

6. The cut data generating apparatus according to claim 3, the controller being configured to further control the cut data generating apparatus to:

generate boundary data for providing, to the workpiece, a mark indicating a boundary between the divided pattern provided with the margin and the margin.

7. The cut data generating apparatus according to claim 3, the controller being configured to further control the cut data generating apparatus to:

determine whether at least one of the divided patterns provided with the margin added falls within one workpiece along with another divided pattern.

8. A non-transitory recording medium recording a cut data generating program, the cut data generating program including instructions for a computer which has a controller, the instructions cause, when executed by the controller, the computer to:

identify a size of an original pattern to be cut;

judge whether the size of the original pattern identified is larger than a size of a workpiece;

divide the original pattern into plural divided patterns smaller than the size of the workpiece in case the size of the original pattern is larger than the size of the workpiece; and determine whether at least one of the plural divided patterns falls within one workpiece along with another divided pattern, and generate cut data for cutting the divided patterns from one workpiece in case at least one of the divided patterns falls within one workpiece along with another divided pattern.

9. The non-transitory recording medium according to claim 8, the instructions further cause, when executed by the controller, the computer to:

obtain a smallest number of workpieces necessary for cutting the original pattern based on an area of the original pattern and an area of the workpiece, divide the original pattern by searching for a divided state of the divided patterns that can fall within the smallest number of workpieces while changing position and a number of dividing lines for dividing the original pattern.

10. The non-transitory recording medium according to claim 8, the instructions further cause, when executed by the controller, the computer to:

add, to at least one of the divided patterns, a margin as a joining margin partially overlapping with another adjacent divided pattern, generate cut data for cutting the divided patterns which involve the at least one of the divided patterns provided with the margin.

11. The non-transitory recording medium according to claim 10, the instructions further cause, when executed by the controller, the computer to:

acquire a shape of an adjacent part overlapping with the margin in the another adjacent divided pattern, add the margin shaped to fall within the acquired shape of the adjacent part.

12. The non-transitory recording medium according to claim 10, the instructions further cause, when executed by the controller, the computer to:

acquire a shape of an adjacent part overlapping with the margin in the another adjacent divided pattern, add the margin shaped to coincide with the acquired shape of the adjacent part.

13. The non-transitory recording medium according to claim 10, the instructions further cause, when executed by the controller, the computer to:

generate boundary data for providing, to the workpiece, a mark indicating a boundary between the divided pattern provided with the margin and the margin.

14. The non-transitory recording medium according to claim 10, the instructions further cause, when executed by the controller, the computer to:

determine whether at least one of the divided patterns provided with the margin added falls within one workpiece along with another divided pattern.

* * * * *